US005103982A

United States Patent [19]

Walter et al.

[11] Patent Number: 5,103,982

[45] Date of Patent: Apr. 14, 1992

[54] CHECK STAGER-FEEDER

[75] Inventors: Douglas B. Walter, Nazareth; Ricardo O. Quincoses, Jr., Reading, both of Pa.

[73] Assignee: Bell & Howell Phillipsburg Company, Allentown, Pa.

[21] Appl. No.: 524,571

[22] Filed: May 17, 1990

[51] Int. Cl.[5] ..... B07C 5/36; B65H 31/30; B65H 43/08

[52] U.S. Cl. ..... 209/547; 209/657; 209/933; 271/176; 271/303; 414/789; 414/790.3

[58] Field of Search ..... 209/547, 551, 554, 657, 209/933; 271/176, 207, 213, 280, 303; 414/789, 789.9, 790.3

[56] References Cited

U.S. PATENT DOCUMENTS

| | | | |
|---|---|---|---|
| 3,077,983 | 2/1963 | Middleditch | 209/551 X |
| 3,683,758 | 8/1972 | Feldkamper | 93/93 |
| 3,785,256 | 1/1974 | Nikkel | 414/789 |
| 3,871,539 | 3/1975 | Nikkel | 414/789.9 X |
| 3,908,836 | 9/1975 | Ikeda | 214/8.5 |
| 3,984,094 | 10/1976 | Stocker | 271/303 |
| 4,006,831 | 2/1977 | Jimenez | 214/6 D |
| 4,078,790 | 3/1978 | Stocker | 271/213 |
| 4,500,002 | 2/1985 | Koshio et al. | 209/534 |
| 4,570,801 | 2/1986 | Brannen | 209/534 |
| 4,602,776 | 7/1986 | York et al. | 271/303 X |
| 4,750,853 | 6/1988 | Van Soest et al. | 414/789.9 |

*Primary Examiner*—Michael S. Huppert
*Assistant Examiner*—Edward M. Wacyra
*Attorney, Agent, or Firm*—Griffin, Branigan & Butler

[57] ABSTRACT

A check stager-feeder for accumulating, in a stage, a predetermined number of checks or sheets in a stack and for high-speed feeding of the stack to further equipment comprising a kicker/stop member movable by a solenoid between two angular orientations for stopping and accumulating into a stack on a fixed slide surface sheets delivered thereto while in one orientation and, while moving to the other orientation, for kicking and thereby feeding upon the slide surface the accumulated stack further. An embodiment of the stager-feeder includes a separator-sheet retriever for marked separator sheets fed thereto and interposed in the stream of received sheets, the separator sheets serving to control the number of sheets to be accumulated in a stack.

9 Claims, 3 Drawing Sheets

CHECK STAGER-FEEDER

BACKGROUND OF THE INVENTION

1. Field of the Invention

This invention relates generally to sheet article feeders, and more specifically to stager-feeders which accumulate in a stage stack a predetermined number of sheet articles seriatim fed thereto and which feed completed stage stacks to further handling equipment.

2. Prior Art and Other Considerations

Sheet article feeders which form a stack of a predetermined size or numbers of articles and therafter deliver the stack to further equipment customarily employ conveyors having driven endless belt devices for feeding of sheet articles to the stack accumulating station and for feeding completed stacks further.

Conventional feeders encounter difficulties when higher feed rates are required, particularly in fast feeding of accumulated stacks to further equipment. Conveyors for such purposes are either intermittently or continuously driven. Particularly in the latter case, movable barriers have to be provided to facilitate accumulation of a stationary stack upon a moving conveyor surface. Accumulation of sheet articles and feeding of sheet stacks becomes increasingly more difficult as conveyor speed is increased, especially when thin sheet articles are to be handled. Feeding of stacks at very high conveyor speeds becomes infeasible with conventional equipment, yet high speed delivery of accumulated stacks is highly desirable. Inertial effects of components offer particular difficulties. In general, conventional devices which might speed up this process excessively increase the complexity of the mechanism to an impractical degree due to high cost and mechanical complexity.

Prior art feeders including aspects that appear related to the present invention are, for example, disclosed in the following U.S. Patents.

Feldkamper (U.S. Pat. No. 3,683,758) discloses an apparatus for forming of stacks of flat workpieces including a belt feed conveyor 3 (FIG. 1) that delivers flat workpieces into a stacking magazine 4. The base of stacking magazine 4 is formed by a conveyor belt 5. The downstream wall 4' of the magazine is rotatable anticlockwise about a horizontal pivot 6, whereby an accumulated stack of workpieces can be released for being carried away by the belt 5.

Ikeda (U.S. Pat. No. 3,908,836) discloses an apparatus for supplying sheets in successive stacks that includes a conveyor mechanism 13 (FIGS. 1, 3, and 6) upon which sheets 23*a* are conveyed in a stack. Sheets 23*a* (in stack) are temporarily held stationary upon belts 45 by retractable stop members 54 that protrude above the belts 45. Members 54 are arranged pivotably about an axis disposed transversely below upper portions of belt 45. Members 54 are turned by a power cylinder 55 between a substantially upright operative position (FIGS. 1 and 3) and an inoperative position under the upper runs of belts 45 (FIG. 6).

Jimenez (U.S. Pat. No. 4,006,831) shows an automatic tortilla counter and stacker that forms orderly stacks of a predetermined number of articles and automatically carries the stacks away. Articles are successively delivered by first conveying means 12 (FIG. 2) onto an article receiving means 32 disposed upon second conveyor means 14 and stacked thereupon. Receiving means 32 comprises a pivotally mounted rack 36. Rack 36 is pivoted by a cam 42. Aligning means 70 includes arms 72 and 74 that act as stops for the article stack and that are selectively pivoted out of the way to allow the stack to be conveyed by conveyor 14 while rack 36 is pivoted to lower the stack onto the conveyor 14 (FIG. 4).

Stocker (U.S. Pat. No. 4,078,790) describes a sheet collector that accumulates a predetermined number of sheets upon a conveyor against a stop 69 (FIG. 4). Stop 69 is pivotably moved downwardly (activated by solenoid 83) out of the way of the sheet stack to release the stack for transport by the conveyor.

Koshio et al (U.S. Pat. No. 4,500,002) discloses an apparatus for sorting and counting a number of banknotes. Banknotes 8 (FIG. 2) are singulated and fed from unit 11 through a judgement unit 12 that senses whether a note is false, damaged or sound, and that provides a signal via control unit 33 to energize a solenoid actuating a branch guide 22 (deflector) to transfer particular notes to reject note stacker 3.

The check stager-feeder of the present invention particularly obviates difficulties of the aforementioned kind and facilitates reliable accumulation of stacks in a stage and reliable high-speed feeding of the stage stacks to further equipment. At the same time, the check stager-feeder of the invention is of relatively low cost and exhibits distinct mechanical simplicity.

SUMMARY OF THE INVENTION

In accordance with principles of the present invention, there is provided an improved check or sheet stager-feeder and an improved method of accumulating a predetermined number of sheets in a stack of sheets in a stage and feeding the accumulated stack at high speed to further equipment. The stager-feeder includes means for holding and kicking the stack upon a stationary slide surface—the means for holding and kicking being actuated by a solenoid. The means for kicking feed (or kick) an accumulated stack at very high speed from the stage along the stationary slide surface to further equipment.

The stager-feeder comprises a kicker/stop member disposed partially above and partially beneath a generally horizontal slide surface that is disposed in the stage region. The kicker/stop member extends through clearance openings in the slide surface. The kicker/stop member includes a stop member and a kicker member mounted upon a common axle that is rotatable over a fixed angle by a solenoid. The axle is disposed in transverse, horizontal orientation beneath the slide surface. A portion of the stop member protrudes above the slide surface at one extreme, angular orientation of the kicker/stop member and serves to stop sheets delivered to and being accumulated upon the slide surface in a region between the stop member and the kicker member. The kicker member is disposed in an upstream direction out of the way of sheets delivered to the stage in this extreme orientation of the kicker/stop member.

While the kicker/stop member is moved to the other extreme, angular orientation by the solenoid, the stop member is lowered beneath the slide surface and the kicker member impacts on trailing edges of sheets in the accumulated stack and kicks the stack along the slide surface out of the stage region to further equipment. The kicker/stop member is moved back, thereafter, to its previous extreme angular orientation in readiness to accumulate a next stack of sheets.

Sheets are generally sensed and counted while being fed in seriatim to the stage region. Sheets fed in seriatim to the stager-feeder can include specifically-marked separator sheets interposed between predetermined numbers of sheets to control the number of sheets to be accumulated in a particular stage stack.

Marked separator sheets are sensed and retrieved at a feed location upstream from the stage. Sensing of a separator sheet controls a solenoid that interposes a diverting device ahead of the separator sheet into the fed stream of sheets for diversion and transport of the separator sheet into an overhead retrieval bin for possible reuse. Sensing of a separator card can control the actuation of the kicker/stop member to kick the accumulated stack onward to further equipment. A sensed sheet count that reaches a preestablished number can alternately serve the same purpose. Both facilities can be employed simultaneously for the same purpose to enhance reliability or they can be utilized separately for different purposes.

BRIEF DESCRIPTION OF THE DRAWINGS

The foregoing and other objects, features and advantages of the invention will be apparent from the following more particular description of preferred embodiments of the invention, as illustrated in the accompanying drawings in which like reference numerals refer to like parts throughout different views. The drawings are schematic and not necessarily to scale, emphasis instead being placed upon illustrating principles of the invention.

DESCRIPTION OF THE PREFERRED EMBODIMENTS

Figure 1:
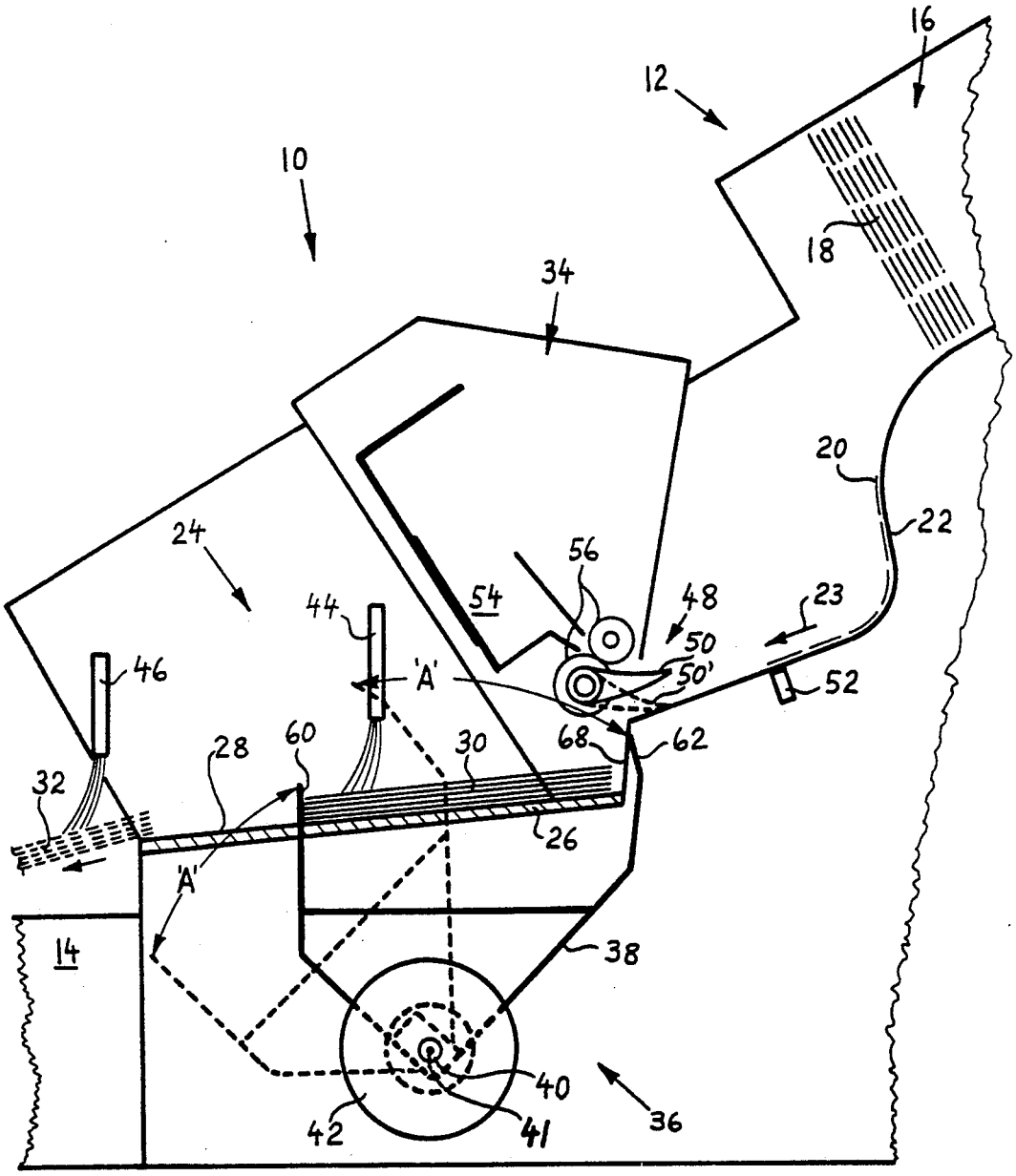
FIG. 1 is a general overall schematic side view of a check stager-feeder according to principles of the present invention.
Figure 2:
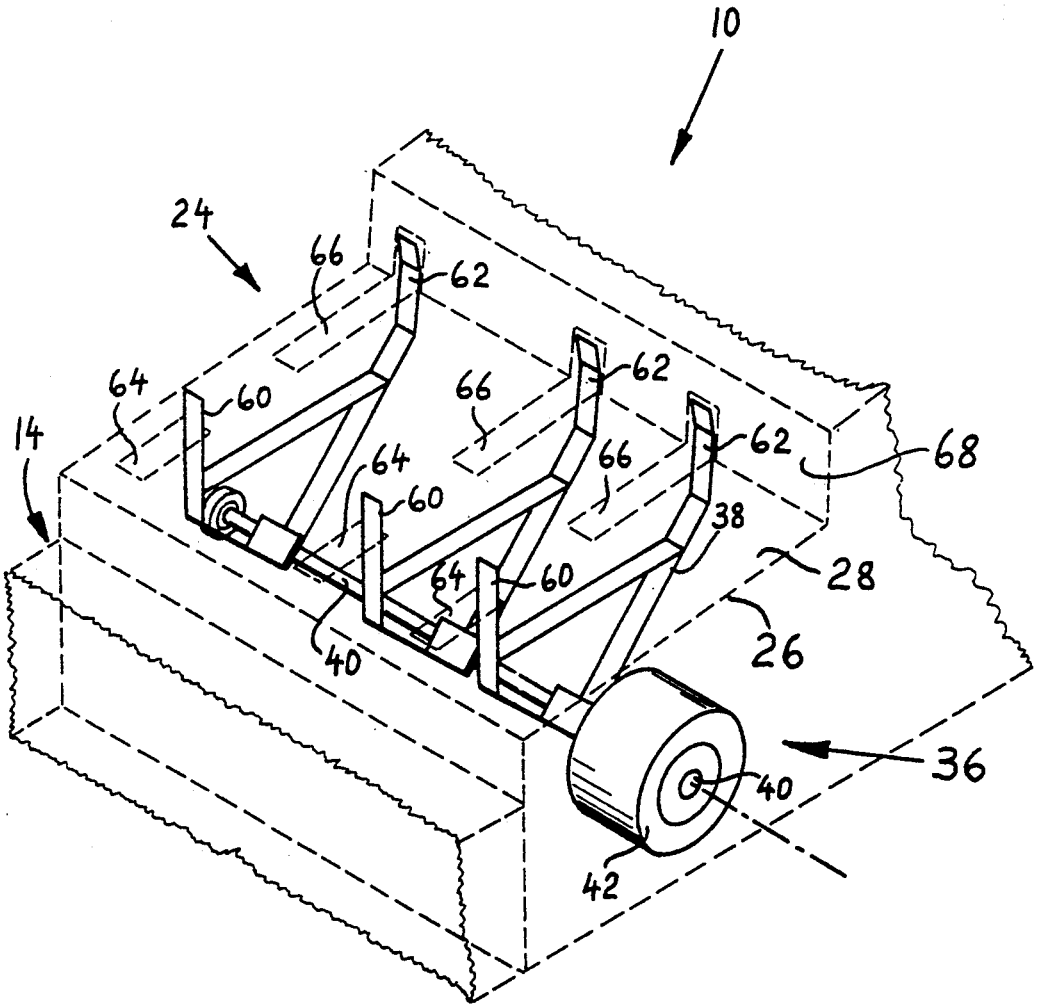
FIG. 2 is a schematic isometric illustration of a main portion of the stager-feeder shown in FIG. 1, as viewed from a point above and to the right side of the front of the apparatus, and presenting further detail; and, FIG. 3 is a schematic side view of an alternate, more-detailed embodiment of the separator retriever device shown in FIG. 1.

Referring to FIGS. 1 and 2, there is depicted the check stager-feeder 10 in an embodiment of the invention. The check stager-feeder 10 is shown in FIG. 1 in association with other equipment that is fragmentally indicated here by a hopper-type check feeder 12 and by further equipment 14. The latter can be, for instance, a transverse conveyor including a raceway for receiving stacks of checks fed thereto from check stager-feeder 10. Check feeder 12, for instance can include a hopper region 16 having a check-stack 18 from which individual checks are singulated and conveyed to check stager-feeder 10. For example, a check 20 is indicated while being conveyed along path 22 and being fed, in direction of arrow 23, into stager-feeder 10.

Check stager-feeder 10 comprises a stage 24 for accumulating a stack of checks (or sheets) and a platform 26 disposed at least partly in the stage area. The upper surface of platform 26 includes a stationary slide surface 28 (FIG. 2) for accumulating thereupon a stack of sheets and for facilitating feeding the stack therealong, as indicated by accumulated stack 30 and fed stack 32, respectively.

Further comprised in stager-feeder 10 is a kicker/stop mechanism 36 that includes at least one prong member 38 mounted to an axle 40, rotatable about an axis 41. Kicker/stop mechanism 36 also comprises a rotary solenoid 42 coupled to axle 40 for rotation of prong member 38 over an angular range 'A' between a first orientation (shown in solid lines) and a second orientation (shown in FIG. 1 by dashed lines). Brush devices 44 and 46 are shown disposed above the general region of the platform and serve, in customary manner, to gently hold down a stack being accumulated and a stack being fed by slidingly contacting the uppermost sheet with minimal normal force.

Check stager-feeder 10 includes a separator retriever 34 for retrieving marked separator sheets selectively from the stream of sheets delivered thereto, for instance here from hopper-type check feeder 12. Marked separator sheets are interposed between numbers of sheets to separate a stream of sheets to be delivered, for example, into different accounts. Retriever 34 includes a diverter device 48 having at least one deflector finger 50 rotatable over an angle by a rotary solenoid (not shown) between a by-pass orientation indicated here by the solid-line representation of a finger 50 and a diversion-orientation indicated by the dashed-line representation thereof (finger 50').

A photosensor 52 is provided to sense and detect marked separator sheets, and can also or alternately count sheets passing by. A signal from photosensor 52 is used to control the operation of the rotary solenoid and therewith the rotation of deflector finger 50. Finger 50 is rotated to diversion orientation 50' when a marked separator sheet is detected by photosensor 52, and is returned to its by-pass orientation after the marked separator sheet has been diverted and transported to a bin 54 provided in the upper portion of separator retriever 34. At least one pair of driven nip wheels 56 is provided for transporting diverted separator sheets therebetween into bin 54, wherein the sheets are accumulated and stored for retrieval and possible reuse. Separator sheets are preferably plain, black sheets or sheets marked with a bold black rim, but any other marking easily detectable by photosensor 52 or the like can be employed equally well.

A sensor such as photosensor 52 can serve to count the number of sheets passing by and can thereby control the number of sheets to be accumulated in stack 30 to a preset number before the stack is fed onward to further equipment 14. Alternately, the sheet count can serve to check operation, while stacks are accumulated until a marked separator sheet is detected, which event then controls the stack accumulation operation by actuation of rotary solenoid 42 to feed an accumulated stack to further equipment 14.

Prong member 38 comprises a stopping prong 60 and a kicking prong 62. Prongs 60 and 62 are spaced apart by such a spacing that a stack of sheets can accumulate freely therebetween when prong member 38 is disposed in its first orientation (indicated by solid lines). At this time, sheets are delivered thereto along the path 22 and drop onto slide surface 28 or onto previously accumulated sheets in the region between prongs 60 and 62. Stopping prong 60 extends above slide surface 28 through clearance opening 64 when in its first orientation. As prong member 38 is rotated into its second orientation through angular range 'A', stopping prong 60 retracts beneath slide surface 28 to allow a stack to be fed therealong. Kicking prong 62 extends above the plane of slide surface 28 at all times. Clearance opening 66 (FIG. 2) is provided for this purpose in slide surface 28. Clearance opening 66 includes an opening portion disposed in the rear wall 68 along the rear end of slide surface 28, as kicking prong 62 can be disposed rearwardly from wall 68 when in its first orientation, as shown.

Angular range 'A' is preferably about 45 degrees, but can be any other angle appropriate to particular geometrical relationships adopted for the device. Slide surface 28 is preferably tilted in feed direction downwardly by a small angle in the range of zero to about five degrees, but larger angles can be alternately utilized without detriment to proper operation.

In operation of the stager-feeder 10, sheets delivered in seriatim along path 22 into the region between prongs 60 and 62 are accumulated and formed into a stack 30 upon slide surface 28. Sheets are stopped from moving further by stopping prong 60 (when in its first orientation as shown by solid lines). When a predetermined stack size has been achieved, solenoid 42 is actuated and, thereby, prong member 38 is rapidly turned through angular range 'A' to its second orientation shown in dashed lines (FIG. 1). Thusly, stopping prong 60 retracts beneath slide surface 28 and kicking prong 62 engages the trailing edges of sheets of stack 30, feeds the stack (while imparting momentum thereto) along sliding surface 28, and stops in its second orientation while the moving stack continues to slide and is fed to further equipment 14, as indicated by stack 32. Thereafter, prong member 38 is returned to its first orientation in readiness for accumulation of the next stack.

Stack acccumulation can be controlled by presetting in a control unit the desired numbers of sheets in stacks and counting sheets delivered in seriatim to the stager-feeder 10, for instance by photosensor 52. Alternately and preferably, stack accumulation is controlled by detection of marked separator sheets that had been interposed between sheets to be delivered to the stager-feeder. The position of marked separator sheets corresponds to desired separations between stacks to be accumulated. Marked separator sheets are detected by photosensor 52 as sheets are transported thereby on the way to the stager-feeder, and are consequently diverted and retrieved from the stream of sheets in separator retriever 34, as described in some detail hereinbefore. The detection of a marked separator sheet controls actuation of solenoid 42 and thereby initiates feeding of an accumulated stack to further equipment by rotation of prong member 38.

Figure 3:
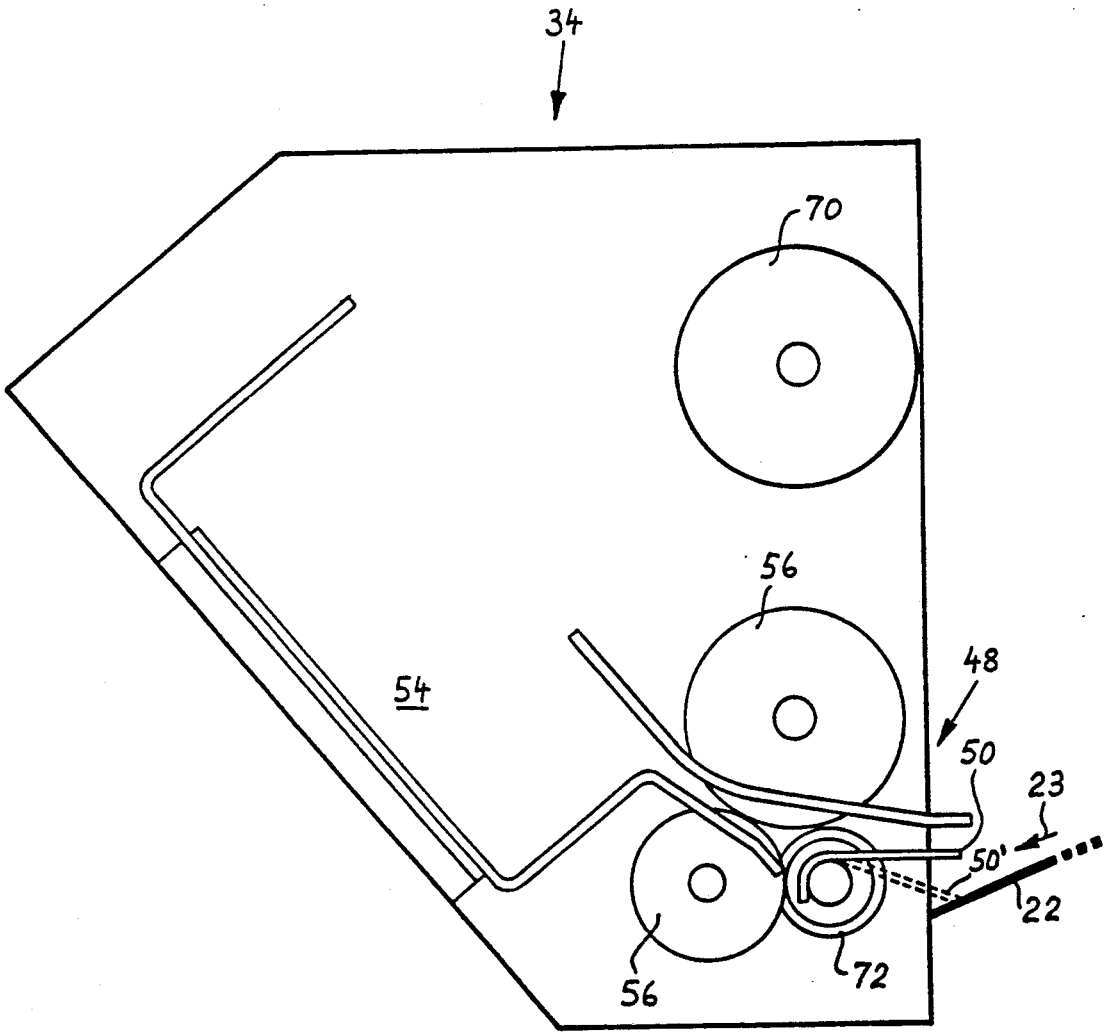

Referring now to FIG. 3, an alternate embodiment of separator retriever 34 is shown here including further details (in addition to those given in FIG. 1).

A drive motor 70 for driving at least the upper nip wheel 56 is disposed in the upper portion of the structure. A rotary solenoid 72 is disposed ahead of the nip wheels 56. Rotary solenoid 72 serves for rotating deflector finger 50 coaxially therewith between the bypass orientation shown in solid lines and the diversion orientation indicated by dashed lines (finger 50').

In operation of separator retriever 34 (FIG. 3), rotary solenoid 72 is energized when a separator sheet is to be retrieved from the stream of sheets fed to stage 24. Such a situation occurs, for instance, upon detection by photosensor 52 of a marked separator sheet being delivered along path 22 (in the direction of arrow 23). Solenoid 72 rotates deflector finger 50 to orientation 50' to intercept the particular sheet and guide it into the nip between nip wheels 56. Nip wheels 56 convey the sheet upwardly into bin 54. Finger 50 is returned to its bypass orientation prior to the approach of a next sheet to the region of diverter drive 48 along delivery path 22.

While the invention has been particularly shown and described with reference to preferred embodiments thereof, it will be understood by those skilled in the art that various changes and modifications in form and details may be made therein without departing from the spirit and scope of the invention.

The embodiments of the invention in which an exclusive property or privilege is claimed are defined as follows:

1. A sheet article feeder for accumulating sheets in the form of a stack and for feeding the stack to further equipment, said feeder comprising:
   - a stage for accumulating a stack of sheets;
   - means for delivering sheets seriatim to said stage;
   - a platform disposed at least in part in said stage;
   - a stationary slide surface delineating an upwardly facing portion of said platform;
   - means for stopping sheets in said stage and forming the stack of sheets upon said slide surface, said means for stopping including at least open stopping prong;
   - means for feeding the stack from said stage to further equipment, said means for feeding including means for kicking the stack along said slide surface, said means for feeding including at least one kicking prong; and
   - kicker/stop means being operative in stopping sheets in said stage while forming the stack of sheets and in feeding the stack from said stage to further equipment, said kicker/stop means including said means for stopping and said means for feeding, said kicker/stop means comprising means for rotating said stopping and said kicking prongs through a predetermined angular range, said angular range having at extremes thereof a first and a second orientation of said stopping and of said kicking prongs respectively, said means for rotating having an axis about which said prongs are rotatable, said axis being oriented transversely with respect to the feed direction of the stack in substantially parallel relation to said slide surface;
   - wherein said stopping prong engages first edges of sheets that are delivered thereto when said stopping prong is oriented at said first orientation; and,
   - wherein said kicking prong engages second edges of sheets of the stack while said kicking prong is being rotated to said second orientation, said kicking prong kicking and thereby feeding the stack along said slide surface.

2. The feeder according to claim 1, wherein said means for rotating includes rotary solenoid means for rotating said stopping and said kicking prongs between said first and second orientations.

3. The feeder according to claim 1, wherein said means for rotating includes means for selectively energizing and deenergizing thereof in correspondence with preestablished counts of sheets being delivered to said stage.

4. The feeder according to claim 1, wherein said means for rotating includes means for selectively energizing and deenergizing thereof in correspondence to sensing of marked separator sheets interposed in the stream of sheets being delivered to said feeder.

5. The feeder of claim 4, wherein said means for delivering includes means for retrieving, prior to delivery of sheets to said stage, marked separator sheets that are interposed in the stream of sheets being delivered to said feeder, said means for retrieving comprising:

means for sensing of marked separator sheets;

means for selectively diverting sensed separator sheets out of the delivery path to said stage;

means for accumulating and storing diverted separator sheets; and means for transporting diverted separator sheets to said means for accumulating and storing.

6. The feeder of claim 5, wherein said means for selectively diverting includes at least one deflector finger and a rotary solenoid device for rotating said deflector finger into and subsequently out of the path of sheets in a location upstream from said stage, said means for sensing including a photodetector for sensing of sheets and for detecting of marked separator sheets in a location along the sheet delivery path that is upstream from the location into which said deflector finger is rotatable;

wherein said means for transporting includes at least a pair of nip wheels for nipping therein and transporting diverted separator sheets to said means for accumulating and storing; and, wherein said means for accumulating and storing includes a bin, and wherein said bin and said nip wheels are disposed above said platform.

7. A method of accumulating seriatim fed sheets into stack form in a stage and feeding the stack from the stage, said method comprising the steps of:

delivering sheets in seriatim to the stage;

stopping and accumulating delivered sheets into a stack in the stage upon a slide surface, said stopping being assured by at least one stopping prong; said step of stopping including a step of extending the stopping prong upwardly from beneath the slide surface to a stopping position; and feeding the stack to further equipment, said step of feeding including a step of kicking the stack along the slide surface, said step of feeding being effected by at least one kicking prong and including steps of:

advancing the kicking prong in direction of feeding of the stack;

engaging trailing edges of sheets in the stack with the kicking prong;

imparting momentum to the stack while moving the stack along the slide surface with the kicking prong; and, repositioning the kicking prong to an accumulating position out of the way of sheet delivery to the stage;

said step of feeding including a step of independent sliding of the stack along the slide surface to further equipment subsequent to and as a consequence of momentum having been imparted to the stack during the step of imparting momentum;

wherein said step of stopping and accumulating and said step of feeding are effected cyclically sequentially by the step of moving the stopping and kicking prongs such that said step of extending the stopping prong substantially coincides with said step of repositioning the kicking prong and said step of kicking the stack is effected while said stopping prong is being rectracted beneath the slide surface; and, wherein said moving step is effected by commonly rotating the prongs between a first and a second orientation about an axis that is oriented transversely with respect to the feed direction of the stack.

8. The method of claim 7, wherein said rotating step is performed by selectively energizing and deenergizing a rotary solenoid.

9. The method of claim 7, further including retrieving separator sheets that are interposed in the stream of sheets, said step of retrieving comprising the steps of:

detecting of marked separator sheets;

diverting detected marked separator sheets out of the normal delivery path; and accumulating and storing diverted separator sheets.

* * * * *